US005246268A

United States Patent [19]

Lerner et al.

[11] Patent Number: 5,246,268

[45] Date of Patent: Sep. 21, 1993

[54] CHAIR ROCKER ACCESSORY

[76] Inventors: Keith Lerner; Heidi Lerner, both of 79 Castle Ridge Dr., East Hanover, N.J. 07936; Ira Lerner, 21422 Bridgeview Dr., Boca Raton, Fla. 33428

[21] Appl. No.: 967,047

[22] Filed: Oct. 27, 1992

[51] Int. Cl.[5] ..... A47C 13/00

[52] U.S. Cl. ..... 297/133; 297/272

[58] Field of Search ..... 297/133, 272, 33

[56] References Cited

U.S. PATENT DOCUMENTS

| | | | |
|---|---|---|---|
| 15,302 | 11/1861 | Strawbridge | 297/272 |
| 71,357 | 11/1867 | Barron | 297/272 |
| 72,178 | 12/1867 | Dunback | 297/272 |
| 75,617 | 3/1868 | Yale | 297/133 |
| 101,802 | 4/1870 | Zahrzewska | 297/133 |
| 138,826 | 5/1873 | Welsh et al. | 297/133 |
| 145,036 | 11/1873 | Wilcox et al. | 297/133 |
| 232,147 | 9/1880 | Reynolds | 297/133 |
| 244,104 | 7/1881 | Andrews | 297/133 |
| 255,104 | 3/1882 | Dryfoos et al. | 297/133 |
| 315,369 | 4/1885 | Work | 297/133 |
| 406,400 | 7/1889 | Jacoby | 297/133 |
| 1,231,151 | 6/1917 | Gerrard | 297/133 |
| 1,367,390 | 2/1921 | Hinson | 297/133 |
| 1,566,157 | 12/1925 | Michaelson | 297/133 |
| 4,126,353 | 11/1978 | Clough | 297/133 |
| 4,832,357 | 5/1989 | Crew | 297/133 |

*Primary Examiner*—Alexander Grosz

*Attorney, Agent, or Firm*—Thomas L. Adams

[57] ABSTRACT

An accessory provides a chair, having a seat and four legs, with a rocking facility. The accessory includes a pair of rockers, each having a longitudinally curved underside and a furrowed upper side sized to receive the legs. The accessory also has a pair of spaced rungs spanning the rockers. Also included is a strap for encircling the rungs and the seat to detachably secure the legs to the furrowed upper side of the rockers.

12 Claims, 1 Drawing Sheet

FIG. 2
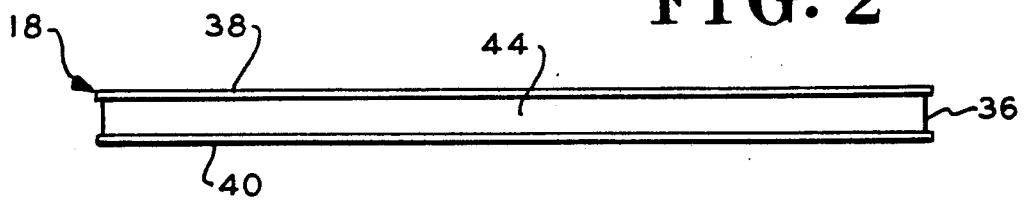
FIG. 3
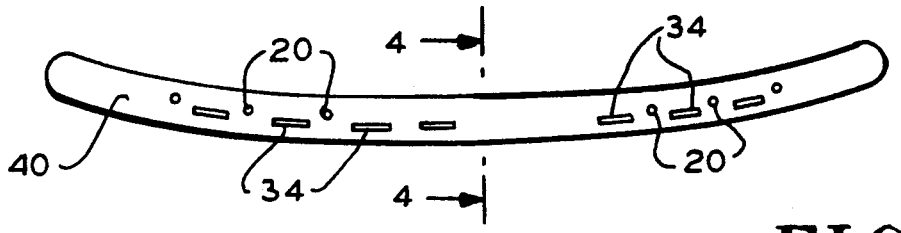
FIG. 4
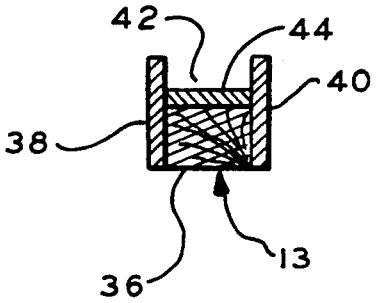
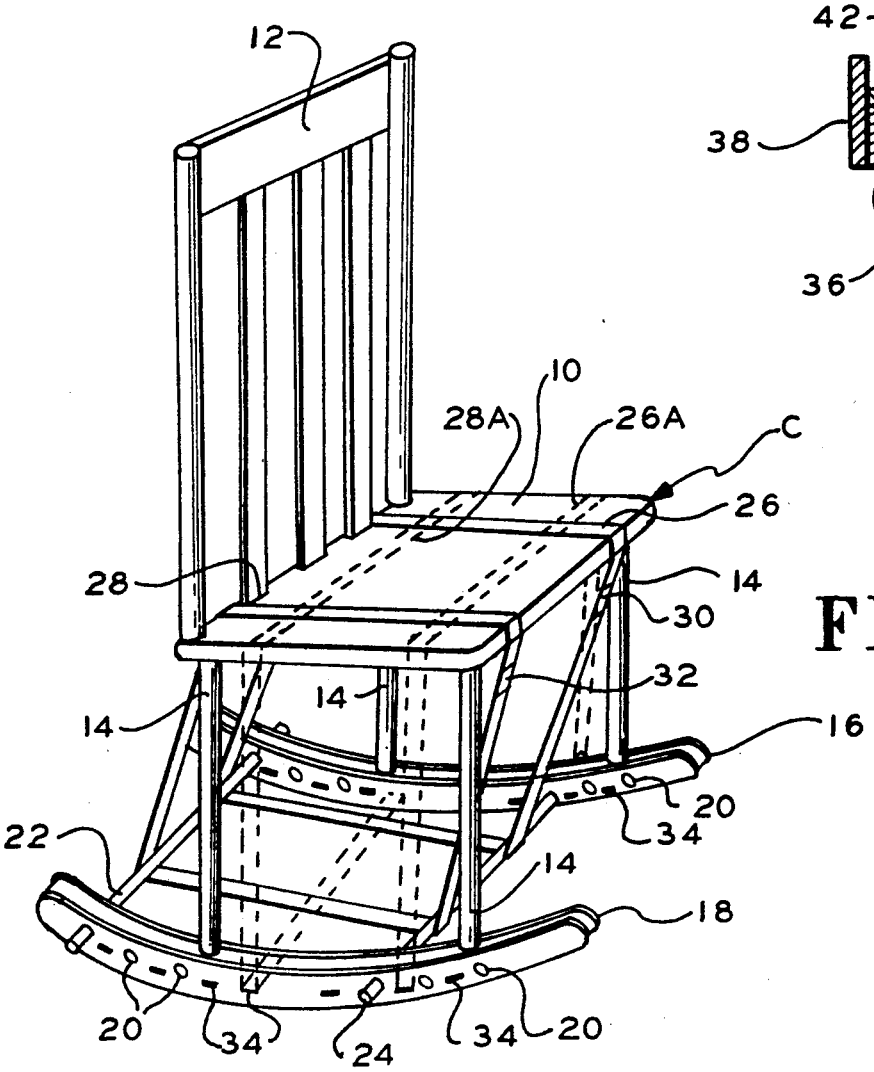
FIG. 1

CHAIR ROCKER ACCESSORY

BACKGROUND OF THE INVENTION

The present invention relates to an accessory that attaches to the legs of a chair to afford it a rocking facility.

People who favor rocking chairs often wish to convert conventional chairs to rocking chairs. Such conversion may be desired when using a chair away from home. Alternatively, a user may only wish temporarily to convert a chair into a rocker.

For this reason, rocker attachments have been proposed as detachable accessories for regular chairs. For example, in U.S. Pat. No. 255,104 a rocker attachment uses a pair of rockers each having a pair of mortises for receiving the four legs of a chair. This rocker attachment is secured to a chair by an adjustable hook that connects to the rungs of the chair. In U.S. Pat. No. 101,802 mortised rocker attachments are tied around the legs and over the rungs of a chair by means of cords and bands. A disadvantage with these attachment systems is that stress is applied to the joint between the rung and leg and the leg or rung can be damaged or defaced. Rungs can be frail and are not normally designed for the pressures generated by rocking.

Other rocker attachments use a curved channel, (see for example U.S. Pat. No. 1,367,390) into which the legs of a chair are placed. Still other rocker attachments permanently modify a chair leg by driving a screw into the leg. See U.S. Pat. No. 1,566,157. Other rocker attachments do not drive a screw directly into the leg but employ set screws that apply high lateral pressure to the leg which creates a significant likelihood of distortion or damage to the leg (see U.S. Pat. No. 1,231,151). Such distortion and potential damage to a chair leg is unacceptable for a visiting guest using a host's chair. Some attachments have attempted to reduce the point pressure on the legs by using wrap-around clamps such as pipe clamps. See U.S. Pat. No. 4,126,353. Other leg clamping devices are shown in U.S. Pat. No. 138,826; 232,147; 244,104; 315,369; and 406,400. A disadvantage with all of these systems is that high stress is applied to the tip of the chair leg. Many chair legs are wooden and are not designed to sustain the high lateral forces associated with rocking. See also U.S. Pat. No. 15,302; 71,357; 72,178; 75,617; and 145,036.

Accordingly, there is a need for an easily used rocker attachment that does not risk damaging chair legs and can be quickly and easily secured to the leg of a chair.

SUMMARY OF THE INVENTION

In accordance with the illustrative embodiments demonstrating features and advantages of the present invention, there is provided an accessory for affording a rocking facility to a chair having a seat and four legs. The accessory has a rocker assembly including: (a) a pair of rockers; and (b) a pair of spaced rungs spanning the rockers. Each of the rockers has a longitudinally curved underside and a furrowed upper side sized to receive the legs. The assembly also includes a strap coupled to the rocker assembly for encircling the seat to detachably secure the legs to the furrowed upper side of the rockers.

By employing such an accessory an improved chair rocker accessory is achieved. In a preferred embodiment, a pair of rockers are spanned by a pair of transverse rungs that mount into transverse holes through the rockers. The chair legs are placed inside furrows atop the rockers and the chair is then strapped into place. In one embodiment, a pair of straps encircles the transverse rungs and the chair seat to attach the rockers. In an alternate embodiment, the rockers have transverse slots. Straps are strung transversely through these slots and encircle the chair seat to attach the rockers.

In this preferred embodiment, multiple holes and multiple slots are provided so that the rungs and the straps can be placed in adjustable alternative positions. Preferably, the rocker is composed of a curved, rectangular bar. The curved bar has curved plates on opposite sides. The bottom of the bar and the plates are flush but the plates extend above the bar to provide a furrow. Preferably, the floor of the furrow is lined with a resilient strip of rubber or similar material to provide a slip proof surface for the chair legs.

BRIEF DESCRIPTION OF THE DRAWINGS

The above brief description, as well as other objects, features, and advantages of the present invention, will be more fully appreciated, by reference to the following detailed description of presently preferred, but nonetheless illustrative embodiments, in accordance with the present invention, when taken in conjunction with the accompanying drawings, wherein:

FIG. 1 is a perspective view of a rocker accessory attached to a chair, in accordance to the principles of the present invention;

FIG. 2 is a top view of one of the rockers of FIG. 1;

FIG. 3 is a side view of the rocker of FIG. 2; and

FIG. 4 is a cross sectional view of the rocker taken along line 4—4 of FIG. 3.

DETAILED DESCRIPTION OF THE PREFERRED EMBODIMENTS

Referring to FIG. 1, a conventional chair C is shown having a seat 10, back 12 and four legs 14. The four legs 14 are shown resting atop the rocker assembly of the accessory. The assembly includes rockers 16 and 18, which have a curved underside and a furrowed upper side. Each of the rockers 16 and 18 have a plurality of transverse holes 20. In this embodiment each rocker has a forward group of three holes and a rear group of three holes, although is some embodiments the number of holes per rung may be two or some other number. Furthermore, a third rung (not shown) may be inserted in an the forwardmost holes 20 to act as a footrest.

Spanning rocker 16 and 18 are a pair of rungs 22 and 24. Rung 22 is inserted in the rearmost transverse hole while rung 24 is inserted through the transverse hole that is third from the front. In other situations, different holes may be used. Rungs 22 may be slender rods of made of wood, plastic, metal or other materials, preferably having some flexibility. Flexible rungs are preferred because chair C may have a greater leg to leg spacing in front than in back. In embodiments adapted to deal with very different leg to leg spacings, the rungs 22 can be a long slender spring mounted inside a hollow flexible tube made, for example, of plastic. In such cases the rungs 22 can flex to accommodate rockers 16 and 18 when they are not parallel.

Chair C is shown attached to rocker 16 and 18 by a strap assembly in the form of a pair of straps 26 and 28. Straps 26 and 28 each have a buckle 30 and 32, respectively. Buckles 30 and 32 can be used to tighten band 26 and 28 so that chair C is firmly secured to the rocker assembly.

Each of the rockers 16 and 18 are shown with a plurality of transverse slots 34. Slot 34 provide an alternate means of attaching chair C to the rockers 16 and 18. An alternate pair of straps 26A and 26*a* shown encircling seat 10, are strung through a pair of slots 34 and rockers 16 and 18. Each of the rockers 16 and 18 are shown with seven transverse slots 34, although in some embodiments a different number can be used instead. For example, four straps per rocker may be preferred in embodiments wherein structural strength and rigidity is more important than adjustability. Straps 26A and 26B can also have buckles for tightening the straps. Instead of buckles, the straps may be elastic and therefore automatically adjusts to various sizes of chairs.

Referring to FIGS. 2, 3, and 4, previously illustrated rocker 18 is shown without other components attached to it. Rocker 18 is shown having a curved, rectangular bar 36. Attached to the sides of bar 36 are a pair of curved plates 38 and 40. Plates 38 and 40 are flush with the underside of bar 36 but extend above the top of bar 36 to form a furrow 42. Mounted on the furrowed side of bar 36 is a resilient antislip runner 44. Runner 44 is a strip of rubber but plasticized foam rubber, various plastic materials or other antislip material can be used in different embodiments. The plates 38 and 40 can be secured to bar 36 by nails, screws, glue or other appropriate means. Runner 44 can be secured to bar 36 by staples, nails, glue or otherwise.

To facilitate an understanding of the principles associated with the foregoing accessory, its operation will be briefly described. Rockers 16 and 18 may be placed in a parallel position at approximately the side to side spacing between the legs of chair C. Since rungs 22 loosely fit in holes 20, the lateral spacing between rockers is easily adjusted. Multiple holes 20 are provided to suit the size of the chair. It is preferred that the rungs are centered between rockers 16 and 18 to provide symmetry and balance.

Once the rockers 16 and 18 are placed into an approximately correct position, chair C can be lifted and placed on top of the rockers as shown. The chair C is shown biased somewhat to the front of the rockers 16 and 18. This provides the conventional orientation where the rockers are longer in the back to provide better support for the backward rock when the feet are lifted from the floor. The shorter rockers in front are adequate since the user can counteract excessive forward rocking by using his or her legs.

With the chair positioned appropriately atop the rockers 16 and 18, straps 26 and 28 can be wrapped around seat 10 and the rungs 22 and 24. Preferably, the are mounted symmetrically about seat 10 so straps 26 and 28 have the same spacing from the right and left edge, respectively, of seat 10. The buckles 30 and 32 can be adjusted to provide adequate tension on the straps 26 and 28.

Some chairs have a solid back which makes the front to back position of straps 26 and 28 impractical. In such instances it may be desirable to wrap the straps laterally. This orientation is shown by the straps 26A and 28*a*, shown in phantom. Straps 26A and 28*a* are routed through the appropriate slots 34 in rocker 16 and 18. Multiple slots are provided so that the straps can be moved to suit the size of the chair. As before, the straps 26A and 28*a* are placed symmetrically about seat 10 and are tightened to firmly attach rockers 16 and 18 to legs 14.

The foregoing assembly can be carried in a compact bag so a traveler can convert chairs in a hotel and other places into a rocking chair. This compact package facilitates transportation of the assembly.

It is to be appreciated that various modifications may be implemented with respect to the above described preferred embodiments. For example, the accessory rungs may be threaded into the various transverse holes to provide a more rigid attachment. Alternatively, pins, clamps, or other fastening means may be used to hold the rungs in place. Also, in some embodiments, the straps or bands can be permanently attached to the rungs so there is no need for a rung-to-rung length of strap. Similarly, the straps can be attached to the rockers directly so that there is no need for a rocker to rocker length of strap. Furthermore, the number, position and shape of the various apertures and slots in the rockers can be altered depending upon the nature of the rungs, the size of the straps, the desired capacity of the rockers, etc. In addition, the rockers can be formed of one or more units made of plastic, metal, wood, etc., with the possible exception of the resilient runner attached atop the rocker. Also, the radius of curvature and the shape of the tips of the rockers can differ in various embodiments. Also, the top of the rockers need not necessarily be curved. Furthermore, in some embodiments, the furrow made in the top of the rockers may have a V-shaped floor to hold more snugly the chair legs. Also, the ends of the straps may have hooks, snaps, or other fastening means to allow attachment to the rungs or the rockers at various positions.

Obviously, many modifications and variations of the present invention are possible in light of the above teachings. It is therefore to be understood that within the scope of the appended claims, the invention may be practiced otherwise than as specifically described.

We claim:

1. An accessory for affording a rocking facility to a chair having a seat and four legs, comprising:

a rocker assembly including:

(a) a pair of rockers each having a longitudinally curved underside and a furrowed upper side sized to receive said legs, and (b) a pair of spaced rungs spanning said rockers; and a strap coupled to said rocker assembly and encircling said seat to detachably secure said legs to said furrowed upper side of said rockers.

2. An accessory according to claim 1 further comprising:

a pair of resilient runners attached to the furrowed upper side of said rockers, so that said slipping between said legs and said rockers is curtailed.

3. An accessory according to claim 2 wherein said rockers have a plurality of transverse holes sized to alternately accept said rungs, so that the position of said rungs is adjustable.

4. An accessory according to claim 3 wherein said strap comprises:

a spaced pair of straps for encircling said rungs and said seat to detachably secure said legs to said furrowed upper side of said rockers.

5. An accessory according to claim 3 wherein said rockers each have a pair of slots, said strap comprising:

a spaced pair of straps each strung through the slots in each one of said rockers, said straps encircling said seat to detachably secure said legs to said furrowed upper side of said rockers.

6. An accessory according to claim 3 wherein each of said rockers comprises:

a curved rectangular bar;

a pair of elongate, curved plates attached to opposite sides of said bar, said plates being flush with the underside of said bar and higher than the upper side of said bar, said transverse holes lying through said bar and said plates.

7. An accessory according to claim 6 wherein said straps each have a buckle for tightening the straps.

8. An accessory according to claim 7 wherein said resilient runners are each sized to fit between said plates.

9. An accessory according to claim 3 wherein said rungs are flexible to allow the rockers to be positioned to accommodate said legs having a different leg to leg spacing in front than in back.

10. An accessory according to claim 1 wherein said strap comprises:

a spaced pair of straps for encircling said rungs and said seat to detachably secure said legs to said furrowed upper side of said rockers.

11. An accessory according to claim 1 wherein said rockers each have a pair of slots, said strap comprising:

a spaced pair of straps each strung through the slots in each one of said rockers, said straps encircling said seat to detachably secure said legs to said furrowed upper side of said rockers.

12. An accessory for affording a rocking facility to a chair having a seat and four legs, comprising:

a pair of rockers each having a longitudinally curved underside and a furrowed upper side sized to receive said legs, said rockers each including:

(a) a curved rectangular bar, and (b) a pair of elongate, curved plates attached to opposite sides of said bar, said plates being flush with the underside of said bar and higher than the upper side of said bar, a plurality of transverse holes and slots distributed through said bar and said plates;

a pair of spaced rungs spanning said rockers, said transverse holes being sized to alternately accept said rungs, so that the position of said rungs is adjustable;

a spaced pair of straps for encircling said seat and either (a) encircling said rungs, or (b) strung through separate ones of the slots in each one of said rockers, to detachably secure said legs to said furrowed upper side of said rockers; and a pair of resilient runners attached to the furrowed upper side of said rockers and sized to fit between said plates, so that said slipping between said legs and said rockers is curtailed.

* * * * *